US006109968A

United States Patent [19]

Wang

[11] Patent Number: 6,109,968

[45] Date of Patent: Aug. 29, 2000

[54] COMPOUND TYPE CONNECTOR

[75] Inventor: Yao-Do Wang, Taipei Hsien, Taiwan

[73] Assignee: C. S. Conser Enterprise Co., Ltd., Taipei Hsien, Taiwan

[21] Appl. No.: 09/392,533

[22] Filed: Sep. 9, 1999

[51] Int. Cl.[7] ..... H01R 13/648

[52] U.S. Cl. ..... 439/607; 439/567; 439/570; 439/541.5

[58] Field of Search ..... 439/541.5, 607, 439/682, 79, 540.1, 80, 444, 540, 608–610, 701, 488, 490, 676, 564, 570, 567

[56] References Cited

U.S. PATENT DOCUMENTS 5,037,330 8/1991 Fulponi .
5,637,014 6/1997 Sukegawa .
5,876,240 3/1999 Derstine .

*Primary Examiner*—Gary F. Paumen
*Assistant Examiner*—P. Nguyen
*Attorney, Agent, or Firm*—Rosenberg, Klein & Lee

[57] ABSTRACT

A compound type connector comprises an inserting seat, a first connector, a second connector, a housing, and a plurality of positioning legs. In the insulating seat, an upper portion and a lower portion therewithin are formed as a first receiving space and a second receiving space, respectively. The first connector is installed at the first receiving space of the insulating seat. The first connector has a plurality of terminals, and one end of each terminal protrudes out of the insulating seat. The second connector is installed within the second receiving space of the insulating seat. The second connector has a plurality of terminals. One end of each terminal protrudes out of the insulating seat. The housing has at least one shielding surface and housing encloses the insulating seat. Two opposite openings correspondent to the first connector and the second connector, respectively, are installed on the shielding surface. The plurality of positioning legs are assembled to the bottom of the housing. By the aforesaid construction, the problems, such as electromagnetic interference, elasticity, and scraping-proof ability, are improved, and thus, the cost is reduced greatly.

4 Claims, 4 Drawing Sheets

COMPOUND TYPE CONNECTOR

BACKGROUND OF THE INVENTION

1. Field of the Invention

The present invention relates to a compound type connector, wherein the problems, such as electromagnetic interference (EMI), elasticity, and harm-proof ability, are improved, and thus, the cost is reduced greatly.

2. Description to the Prior Art

In prior art, a compound type connector integrates a plurality of input/output connectors of different types. For example, an information universe connector and a network connector are staked to form as an integral body. The compound type connector has an insulating seat. The insulating seat is enclosed by a housing which is made of metal and serves to prevent electromagnetic interruption.

However, in the prior art compound type connector, in order to have a preferred shielding effect, in general, it is made of material capable of preventing EMI. Moreover, in order to prevent that the housing is harmed by scraping in plating, a plating process with a preferred effect but having a higher cost is selected. Since the positioning legs at the bottom of the housing must have a preferred elasticity, a preferred inserting tolerance, no elastic fatigue, in general, it is made of elastic material. Therefore, an integrated compound type connector must take in consideration of the problems of electromagnetic interference (EMI), elasticity, and scraping-proof ability. Therefore, the cost can not be well controlled. Furthermore, not all of the materials capable of preventing EMI have a preferred elasticity. Thus, a proper material is difficult to be selected.

SUMMARY OF THE INVENTION

Accordingly, the primary object of the present invention is to provide a compound type connector comprises an inserting seat, a first connector, a second connector, a housing, and a plurality of positioning legs. In the present invention, the housing and the positioning legs are manufactured in different modes. The housing and positioning legs are manufactured according to the required characteristics. Namely, the housing is made of metal material capable of preventing the electromagnetic interruption and may suffer a plating process which will scrape the housing. The positioning legs are made of metal with preferred elasticity so that the positioning legs have a preferred elasticity, is tolerable to be inserted repeatedly, and have no elastic fatigue. Since the housing and the positioning legs are manufactured individually, thus the problems of electromagnetic interference, elasticity, and scraping-proof ability of the housing and the positioning legs can be considered individually. Not only the cost is reduced, but also it is economic in cost.

BRIEF DESCRIPTION OF THE DRAWINGS

The various objects and advantages of the present invention will be more readily understood from the following detailed description when read in conjunction with the appended drawing.

DESCRIPTION OF THE PREFERRED EMBODIMENT

Figure 1:
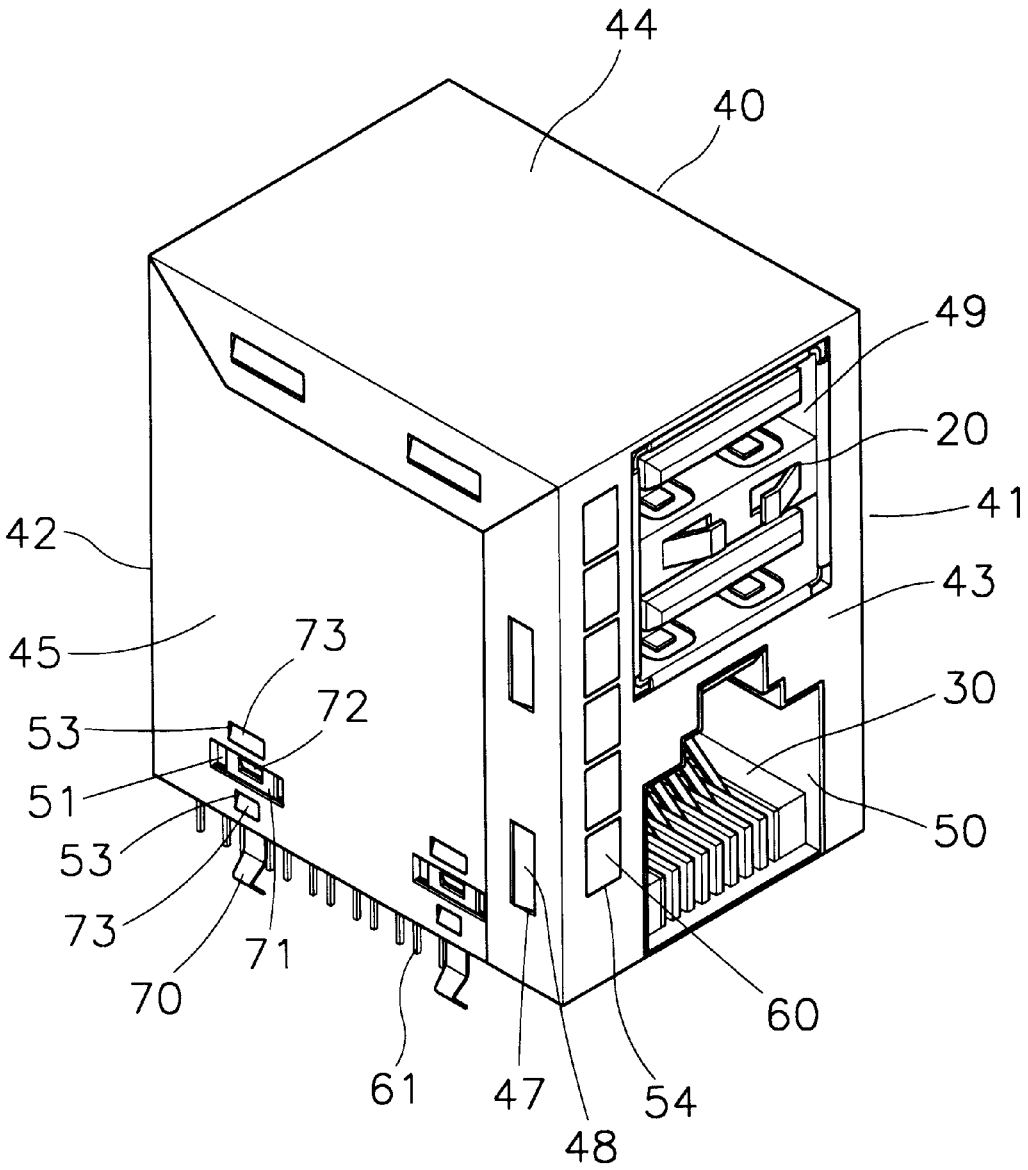
FIG. 1 is a perspective view of the present invention.
Figure 2:
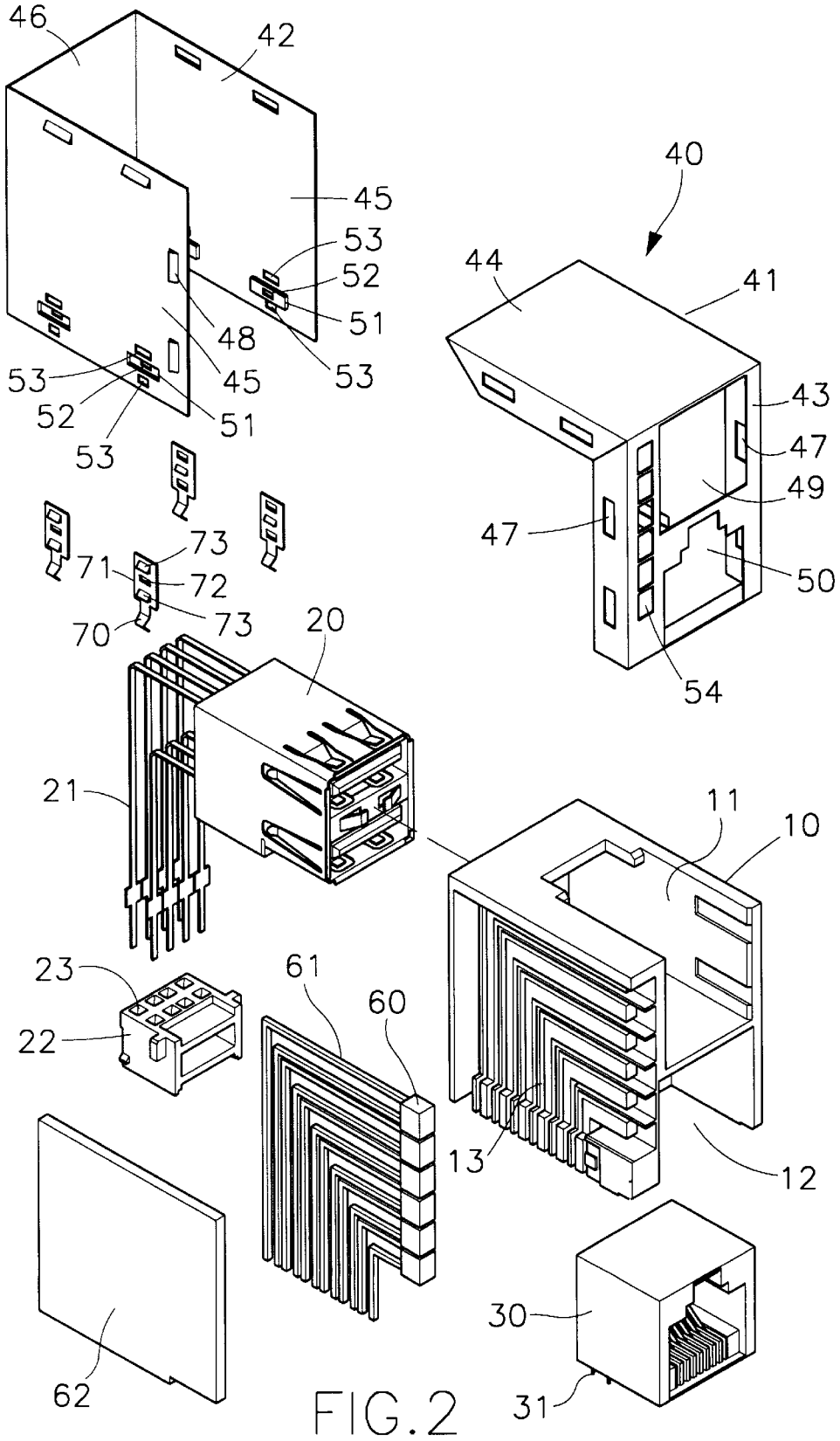
FIG. 2 is an exploded perspective view of the present invention.
Figure 4:
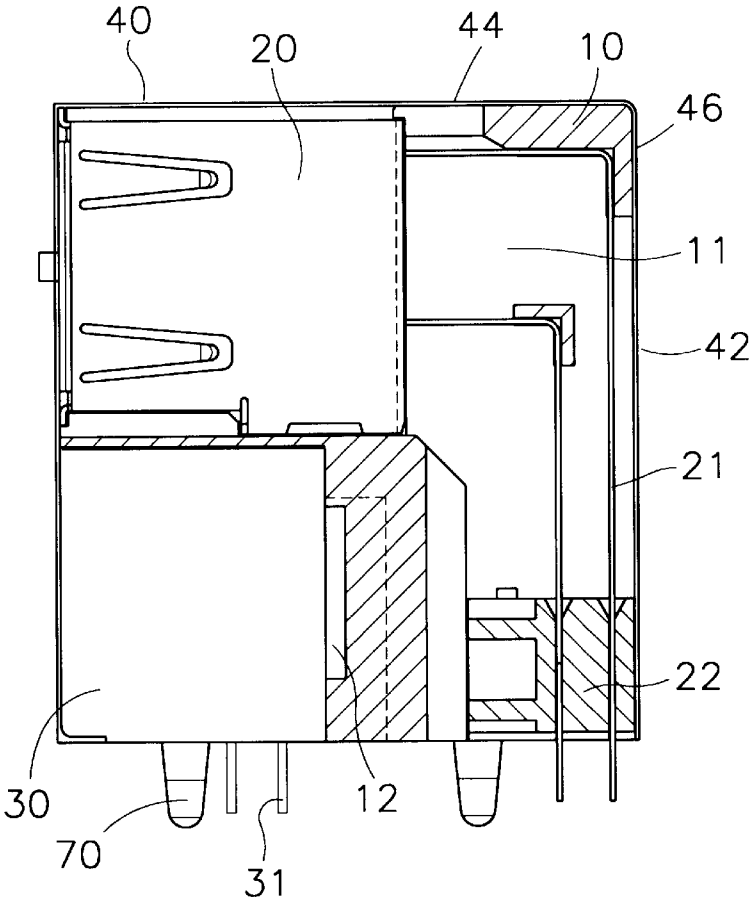
FIG. 4 is a lateral cross sectional view of the present invention.
Figure 3:
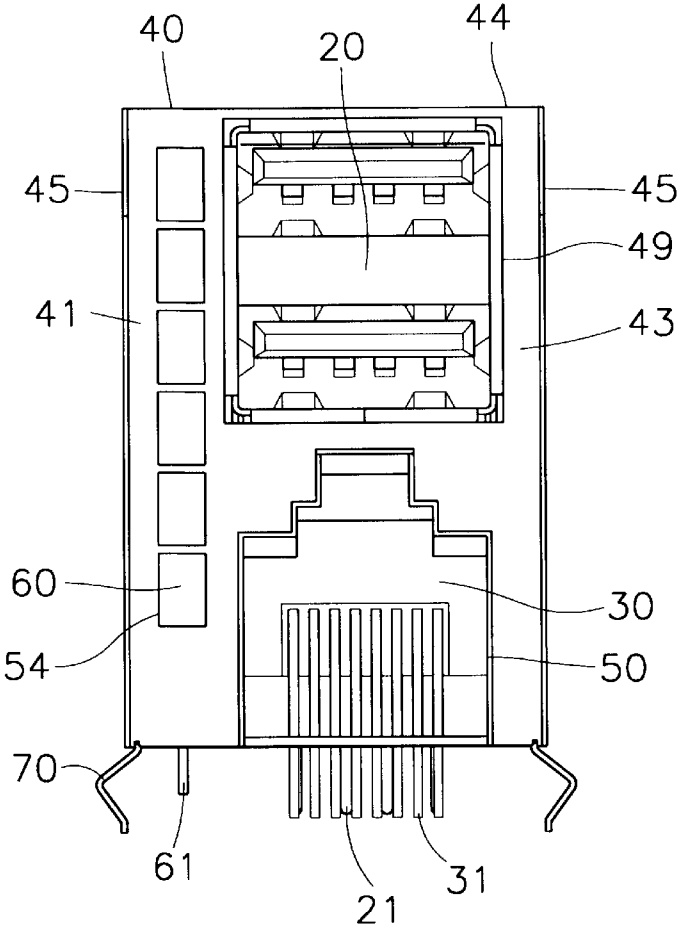
FIG. 3 is a front view of the present invention.

With reference to FIGS. 1, 2, 3, and 4, the compound type connector of the present invention is illustrated. The compound type connector of the present invention includes an insulating seat 10, a first connector 20, a second connector 30, a housing 40 and a plurality of positioning legs 70. The insulating seat 10 is made of plastics and other materials and is an approximately cubic body. The upper and lower portion within the insulating seat 10 are formed as a first receiving space 11 and a second receiving space 12. The first receiving space 11 is opened at one side. The first receiving space 11 penetrates to the rear side of the insulating seat 10 and then turns downwards to the bottom of the insulating seat 10. The front and bottom sides of the second receiving space 12 are opened.

The first connector 20 is a commercial universal connector, which is installed within the first receiving space 11 of the insulating seat 10. The first connector 20 has a plurality of terminals 21 capable of being electrically connected to correspondent connectors. The lower end of each terminal 21 of the first connector 20 protrudes to the bottom of the insulating seat 10. A terminal seat 22 is properly secured to the interior of the insulating seat 10 by buckling or other ways. A plurality of penetrating positioning holes 23 are installed at the terminal seat 22. Each of the positioning holes 23 is correspondent to the terminal 21. The terminal 21 of the first connector 20 penetrates through the positioning hole 23 so that the terminal 21 may be positioned steadily.

The second connector 30 is a commercial network connector and is installed within the second receiving space 12 of the insulating seat 10. The second connector 30 has a plurality of terminals 31 capable of being electrically connected to correspondent connectors. The terminals 31 of the second connector 30 has a lower end protruding to the bottom of the insulating seat 10.

The housing 40 is made of material capable of preventing the interruption of electromagnetic field, and is tolerable to scrape in the plating process. The housing 40 is formed by a front housing 41 and a rear housing 42. The front housing 41 has a front shielding surface 43 and a top shielding surface 44. The rear housing 42 has a rear shielding surface 46. The front housing 41 and the rear housing 42 are installed with a plurality of buckling holes 47 and a plurality of buckling bodies 48, respectively. By buckling the buckling holes 47 with correspondent buckling bodies 48, the front housing 41 and the rear housing 42 are assembled as a housing 40. The housing 40 encloses the insulating seat 10. The front shielding surface 43 is installed with an upper and a lower opening 49, 50, respectively, which are correspondent to the first connector 20 and the second connector 30, so that the matched connectors may be connected to the first connector 20 and the second connector 30. At least two inserting grooves 51 protruded from the inner wall are installed at the shielding surfaces of the housing 40 near the bottom end. Each lateral wall of the inserting groove 51 is installed with a buckling hole 52. The lateral shielding surfaces 45 are installed with a buckling holes 53 at the upper and lower sides of the inserting groove 51.

The positioning legs 70 are made of metal materials with preferred elasticity. The upper end thereof has an inserting plate 71. A buckling body 72 protruded from the inner wall is installed on the inserting plate 71. The upper and lower sides of the buckling body 72 each is installed with a buckling body 73 protruded from the outer wall. The buckling bodies 72 and 73 are correspondent to the buckling holes 52 and 53 of the housing 40. The positioning legs 70 are inserted into the inserting grooves 51 on the housing 40 by the inserting plates 71. By buckling the buckling bodies 72, 73 and the buckling holes 52 and 53 of the housing 40, a compound type connector integrating two connectors 20, 30 are formed.

Figure 5:
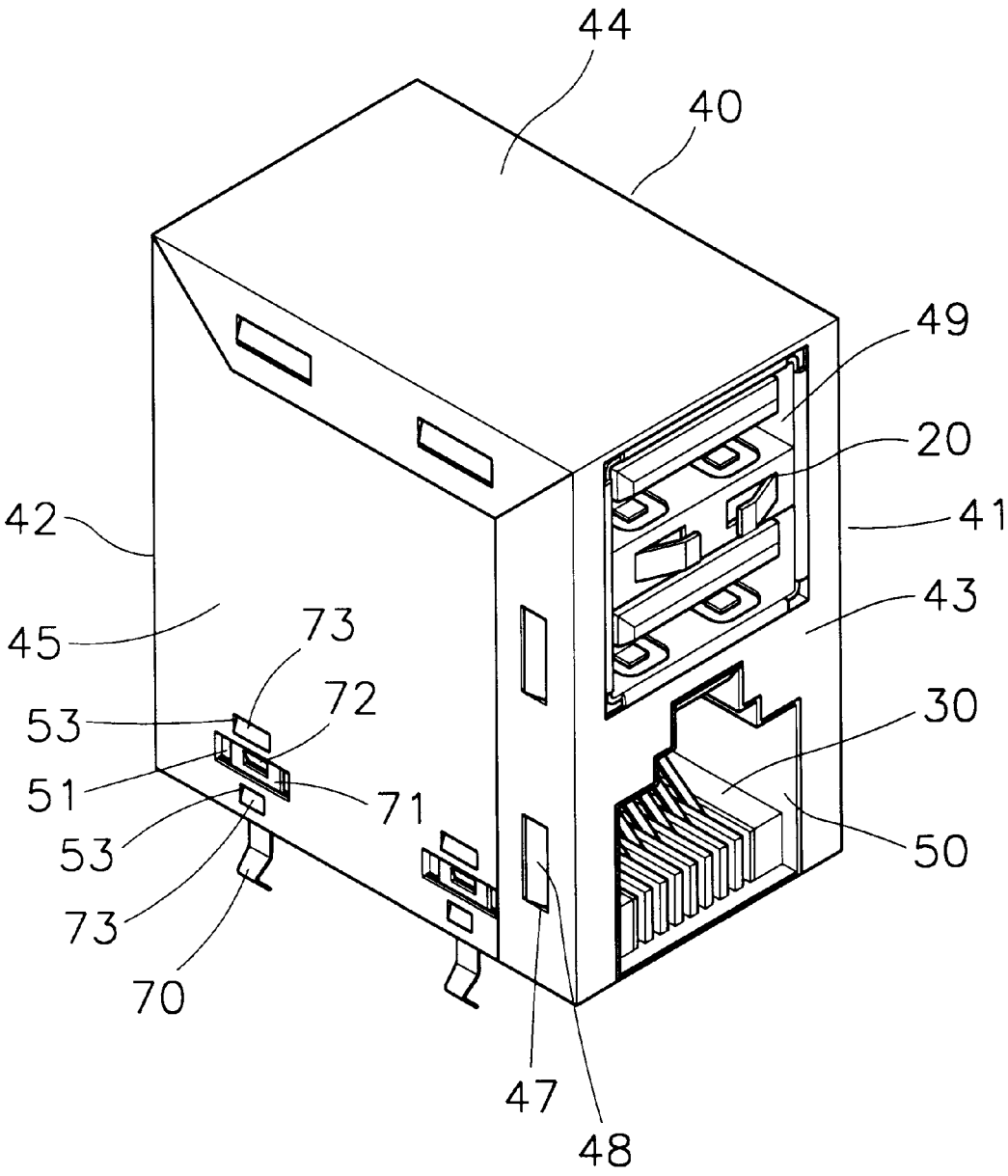
FIG. 5 is a perspective view showing another embodiment of the present invention.

Furthermore, a plurality of light emitting diodes 60 can be further installed. A plurality of L shape trenches 13 are installed at the left or right wall of the insulating seat 10. The light emitting diode 60 and the legs 61 are installed in the trenches 13 of the insulating seat 10. The lower ends of the legs 61 of the light emitting diode 60 protrudes from the bottom of the insulating seat 10. A fixing plate 62 is installed at the outer side of the light emitting diode 60 for fixing the light emitting diode 60 to the trench 13 of the insulating seat 10. Besides, a plurality of windows 54 are installed on the housing 40. The windows 54 are correspondent to the light emitting diodes 60. The light emitting diodes 606 are selectively installed, thus, they can be neglected (as shown in FIG. 5).

In the present invention, the housing 40 and the positioning legs 70 are manufacturing in different modes. The housing 40 and positioning legs 70 are manufactured according to the required characteristics. Namely, the housing 40 is made of metal material capable of preventing the electromagnetic interruption and may suffer a plating process which is harmful to the housing. The positioning legs 70 are made of metal with preferred elasticity so that the positioning legs have a preferred elasticity, are tolerable for being inserting repeatedly, and have no elastic fatigue. Since the housing 40 and the positioning legs 70 are manufactured individually, the problems of electromagnetic interference, elasticity, and scraping-proof ability of the housing and the positioning legs can be considered individually. Not only the cost is reduced, but also it is economic in cost.

In summary, by the present invention, the problems in a compound type connector in the prior art, such as electromagnetic interference, elasticity, and scraping-proof ability, are improved.

Although the present invention has been described with reference to the preferred embodiment, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

We claim:

1. A compound connector comprising:

an insulating seat having a first receiving space and a second receiving space formed therein;

a first connector having a first set of terminals, said first connector being received within said first receiving space wherein said first set of terminals projects from said insulating seat;

a second connector having a second set of terminals, said second connector being received within said second receiving space wherein said second set of terminals projects from said insulating seat;

a rear housing member having first and second lateral shielding surfaces and a rear shielding surface, said first and second lateral shielding surfaces having a first set of buckling body members projecting therefrom and having a first set of buckling holes formed therethrough;

a plurality of positioning legs, each of said positioning legs having a second buckling body member formed thereon, said second buckling body members being received in locking engagement with said first set of buckling holes;

a front housing member having a top shielding surface and a front shielding surface, said front shielding surface having an upper opening and a lower opening formed therethrough, said front-housing member further having a second set of buckling holes formed therethrough, said second set of buckling holes engaging said first set of buckling body members wherein said front housing member and said rear housing member are releasably coupled in locking engagement to form a shield housing, said insulating seat being received within said shield housing.

2. The compound connector as recited in claim 1, wherein said first receiving space is open at a first side, said first receiving space extends penetrating to a rear side of said insulating seat and continues to a bottom end of said insulating seat, said second receiving space having a front section and a bottom section, said front and bottom sections being open.

3. The compound connector as recited in claim 1, wherein a terminal seat is fixed to said insulating seat, a plurality of positioning holes located on said terminal seat each of said first set of terminals of said first connector passing through a respective positioning hole.

4. The compound connector as recited in claim 1, wherein said first connector is a universal connector and said second connector is a network connector.

* * * * *